United States Patent [19]

Riedle et al.

[11] Patent Number: 4,981,236

[45] Date of Patent: Jan. 1, 1991

[54] ANTI-THEFT DEVICE FOR USE IN A COIN-OPERATED DISPENSING MACHINE FOR NEWSPAPERS AND THE LIKE

[76] Inventors: Robert D. Riedle, 3176 Birch Row; Robert D. Riedle, 909 Touraine, both of East Lansing, Mich. 48823

[21] Appl. No.: 347,050

[22] Filed: May 3, 1989

[51] Int. Cl.[5] ..... G07F 11/16

[52] U.S. Cl. ..... 221/241; 221/151; 221/152; 221/242; 221/279; 221/304

[58] Field of Search ..... 221/151, 152, 191, 192, 221/241, 242, 304, 278, 232, 289, 279, 227, 281; 33/501, 783

[56] References Cited

U.S. PATENT DOCUMENTS

| | | | |
|---|---|---|---|
| 1,881,651 | 7/1930 | Judge | 33/501 |
| 3,747,733 | 7/1970 | Knickerbocker . | |
| 3,905,530 | 9/1975 | Emmel | 221/241 |
| 4,569,461 | 2/1986 | Orr | 221/232 |

*Primary Examiner*—Andres Kashnikow
*Assistant Examiner*—W. T. Waffner
*Attorney, Agent, or Firm*—Woodard, Emhardt, Naughton, Moriarty & McNett

[57] ABSTRACT

An anti-theft apparatus for use in a dispensing machine for newspapers and the like having a coin-operated locking access door. The apparatus includes a cover panel sized to mount within the access opening in the rack. The cover panel restricts access into the dispensing machine is through a T-shaped access opening in the cover panel. Newspapers and the like stacked within the dispensing machine may be grasped through the vertical slot in the T-shaped access opening and raised for removal through the horizontal slot in the opening along the axis of the horizontal slot. A pivoting gauge gate mounted to the cover panel above the T-shaped access opening restricts the thickness of newspapers and the like which may be removed through the hozizontal slot. The gauge gate pivots between an open position wherein newspapers and the like can be removed through the horizontal slot and a closed position wherein access through the horizontal slot is substantially restricted. The relative opening of the gauge gate may be selectively adjusted to accommodate newspapers and the like of varying thicknesses. A locking means operably associated with the gauge gate prevents successive withdrawal of newspapers through the horizontal slot. The locking means includes a reset means for resetting the locking means upon closing of the access door.

32 Claims, 6 Drawing Sheets

ANTI-THEFT DEVICE FOR USE IN A COIN-OPERATED DISPENSING MACHINE FOR NEWSPAPERS AND THE LIKE

BACKGROUND OF THE INVENTION

Field of the Invention

The present invention relates generally to the field of anti-theft devices and, more particularly, to such devices which are used in coin-operated dispensing machines for newspapers and the like to deter pilfering of extra copies therefrom.

One conventionally well known type of coin-operated newspaper dispensing machine has an enclosed storage cabinet for storing a stack of newspapers therein and a coin-operated front opening access door through which the stack of newspapers inside the cabinet may be accessed. Newspaper dispensing machines of this type are highly susceptible to pilfering because once the access door is unlatched by inserting the appropriate amount of coins in the coin mechanism, there is nothing to prevent the operator from removing as many additional newspapers as are stored in the cabinet.

Despite the ease with which standard dispensing machines of the above type may be pilfered, such machines remain in use because, among other reasons, they are relatively simple in design and are therefore (1) dependable in operation, (2) easy for purchasers to operate, and (3) inexpensive to manufacture.

Efforts have been made to design a newspaper dispensing machine which is theft-proof. One such design is disclosed in U.S. Pat. No. 3,747,733 to Knickerbocker. This device includes a mechanism for preventing more than one newspaper from being removed from the cabinet at a time and an adjustment mechanism to allow for newspapers of differing thicknesses. An immediate drawback of this device is that it is not well suited for retrofitting conventional dispensing machines already in use. Another drawback of this device is that because the device is apparently designed to eliminate pilfering altogether, it is relatively difficult for a purchaser to manipulate and remove the purchased newspaper from the cabinet. Further, the design is sufficiently complex that access within the cabinet is limited and loading and unloading of the dispensing machine is rendered somewhat burdensome.

SUMMARY OF THE INVENTION

An anti-theft apparatus for use in a dispensing machine for newspapers and the like having a coin-operated locking access door according to one embodiment of the present invention is characterized by a cover panel sized to mount within and restrict access through the access opening of the dispensing machine. The cover panel has horizontal and vertical slots therein defining a T-shaped access opening. The width of the vertical slot is sized substantially smaller than the width of newspapers and the like stacked within the dispensing machine while being sufficiently wide to permit grasping of newspapers and the like stacked within the dispensing machine. Further, the width of the horizontal slot is sized to permit newspapers and the like stacked within the dispensing machine to be withdrawn therethrough along the axis of the horizontal slot. A restriction means is also provided for restricting the removal of newspapers and the like through the T-shaped access opening. The restriction means is provided with a gauge gate pivotably mounted to the cover panel above the T-shaped access opening and pivots between an open position wherein newspapers and the like can be removed through the horizontal slot and a closed position wherein access through the horizontal slot is substantially restricted. The restriction means is further characterized by having an adjustment means for selectively adjusting the relative opening of the gauge gate to accommodate newspapers and the like of varying thicknesses and a locking means operably associated with the gauge gate for preventing successive withdrawal of newspapers through the horizontal slot. The locking means includes a reset means for resetting the locking means upon closing of the access door.

Accordingly it is an object of the present invention to provide an improved anti-theft apparatus for coin-operated machines for dispensing newspapers and the like.

It is another object of the present invention to provide an improved anti-theft apparatus for coin-operated machines for dispensing newspapers and the like which can be retrofitted in the field to existing newspaper dispensing machines.

It is another object of the present invention to provide an improved anti-theft apparatus for coin-operated machines for dispensing newspapers and the like which is capable of being withdrawn from the storage cabinet as a unit to permit easy loading and unloading of newspapers and the like.

It is another object of the present invention to provide an improved anti-theft apparatus for coin-operated machines for dispensing newspapers and the like which permits easy manipulation and removal of the purchased newspaper while making it relatively difficult to remove additional copies.

Further objects and advantages of the present invention will become more apparent by reference to the drawings and detailed description which follows.

DESCRIPTION OF THE PREFERRED EMBODIMENT

Figure 1:
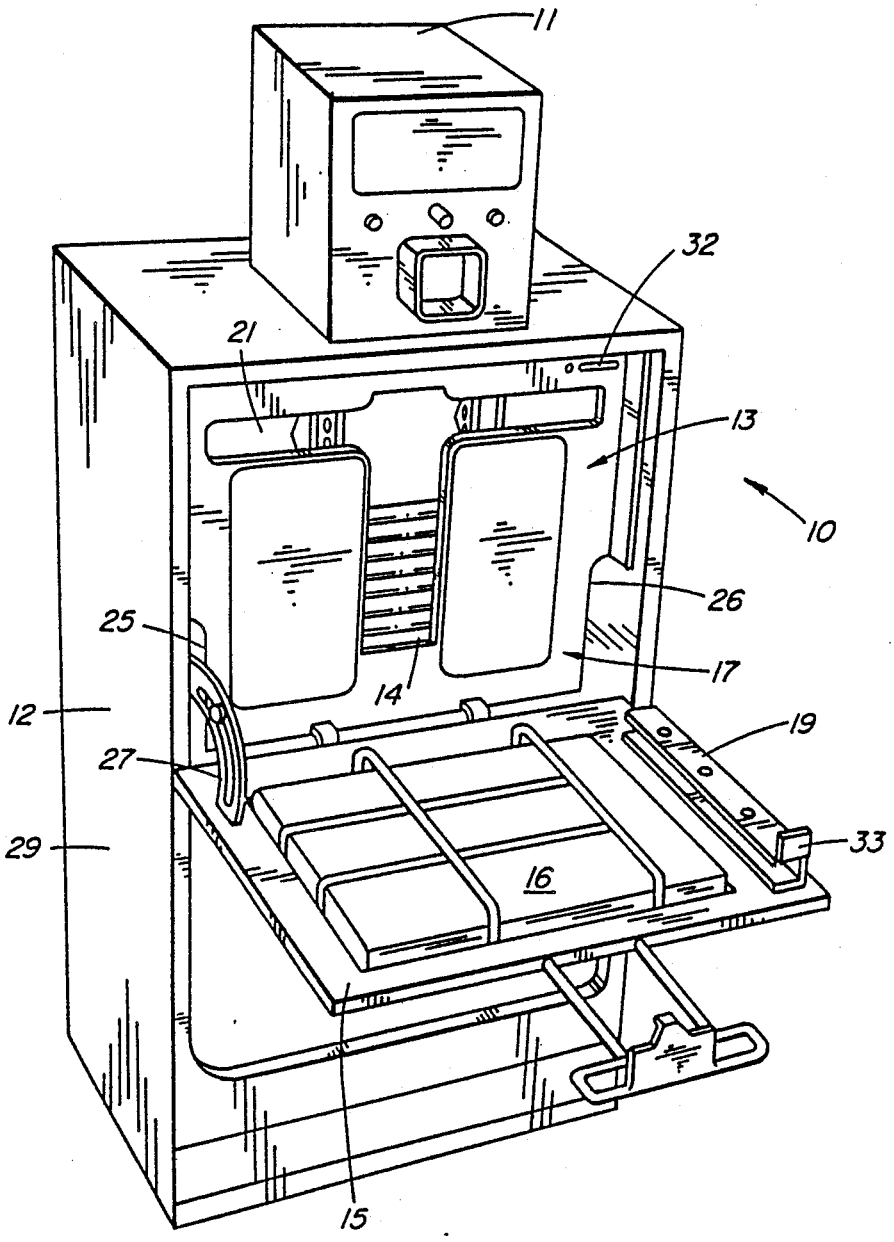
FIG. 1 is a perspective view of a coin-operated newspaper dispensing machine of conventional design with the anti-theft device of the present invention installed therein.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is generally depicted at 10 a coin-operated newspaper dispensing machine of conventional design with the anti-theft device of the present invention installed therein. The newspaper dispensing machine 10 shown in FIG. 1 is of a conventionally well known design familiar to persons in the art by the designation "K-80". The dispensing machine 10 is generally characterized by a box-shaped coin mechanism 11, a cabinet 12 defining therein a storage compartment 13 for storing a stack of newspapers 14, and a front opening and downward pivoting access door 15 having a see-through glass display window behind which a display copy 16 of a newspaper is mounted. Although not shown, machine 10 also includes a conventional elevator mechanism inside cabinet 12 which serves to keep newspapers stacked within cabinet 12 at a desired constant height level within the cabinet for easy access as newspapers are purchased.

Figure 3:
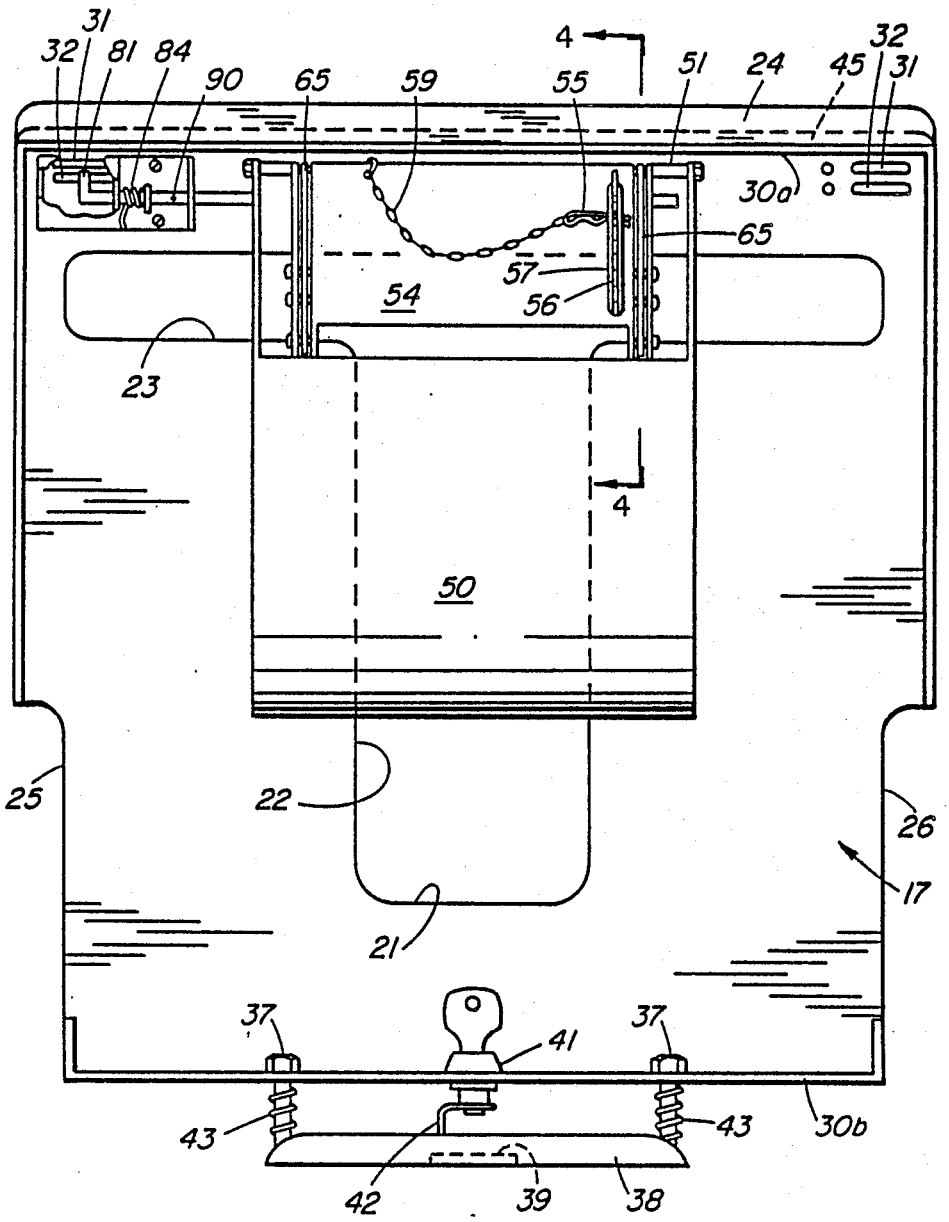
FIG. 3 is a rear elevation view, partially broken away, of the front cover panel of FIG. 2.

The preferred embodiment of the anti-theft device of the present invention includes three separate components or sub-assemblies which are specially adapted for easy retrofitting in the field to existing dispensing machines of the type generally depicted in FIGS. 1 and 3. The three separate components or sub-assemblies include a cover panel sub-assembly 17, a cover panel mounting bracket 18 (FIG. 5) and a reset tab mounting bracket 19.

Figure 2:
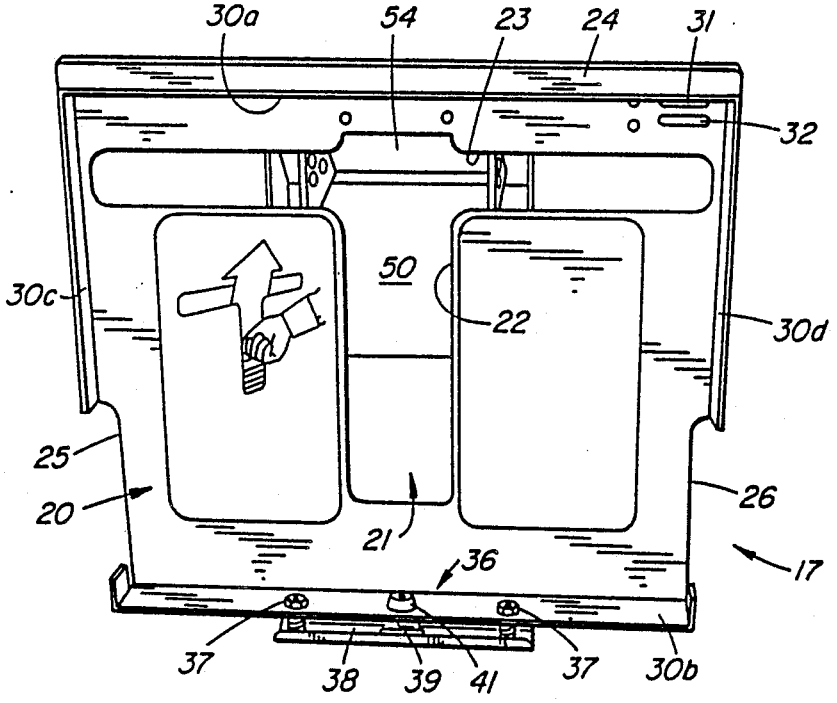
FIG. 2 is a perspective view of the front cover panel of the present invention.

Referring now also to FIG. 2, mounted inside the storage compartment of the machine 10 directly behind the access door 15 is the cover panel sub-assembly 17. Cover panel sub-assembly 17 includes an access cover panel 20 which is sized and shaped to restrict access into the rectangular shaped and front facing opening of the cabinet 12 through a generally T-shaped access opening 21. The width of the vertical slot 22 in opening 21 is dimensioned to permit easy hand manipulation of newspapers 14 while also being substantially smaller than the width of newspapers 14 stacked inside cabinet 12. The height of the horizontal slot 23 in opening 21 is dimensioned to correspond to the maximum anticipated thickness of newspapers to be received therethrough, which is typically the Sunday edition. Similarly, the width of the slot 23 is sized slightly wider than the width of newspapers 14. In the preferred embodiment shown, the width of the vertical slot 22 is 3 inches, the height of the horizontal slot 23 is 1 and ½ inches, and the width of the slot 23 is 16 inches.

The front facing surface of the cover panel 20 is recessed approximately 1 and ½ inches from the top lip 24 of panel 20, the recess being defined by top wall 30*a*, bottom wall 30*b*, and side walls 30*c* and 30*d*. The purpose of the recess is to accommodate the display newspaper received in the rear side of door 15 when the door is in its upright and closed position.

Along the sides of cover panel 20, in the lower portion thereof, are two vertically extending recesses 25 and 26. In the embodiment shown, the right recess 26 is non-functional, and is shaped as a mirror image of recess 25 for aesthetics only. The left recess 25, however, is shaped to receive therethrough an arcuate shaped door bracket 27 fixedly mounted at one end to the inside facing side of access door 15 and slidably mounted at the other end to the interior facing surface of cabinet wall 29. Bracket 27 serves to limit the downward swinging movement of door 15 to the horizontal position shown in FIG. 1.

At the extreme upper right corner of cover panel 20 in FIG. 2 are two horizontally extending slots 31 and 32. The lowermost slot 32 is sized and positioned to receive therethrough reset tab 33 mounted on door 15 when door 15 is in its upright and closed position. The uppermost slot 31 is sized and located to receive reset tab 33 therethrough when cover panel 20 is removed from cabinet 12 during loading of cabinet 12 which will be described later herein.

Reset tab 33 is fixedly attached to and extends from a channel shaped reset tab mounting bracket 19 which is in turn fixedly mounted to the inside facing surface of door 15 by three spaced apart mounting bolts (not shown). The reset tab mounting bracket 19 is designed to mount to three preexisting mounting holes in door 15. Access holes 35 are positioned directly above each of the corresponding mounting holes in bracket 19 to provide easy access to the mounting bolts during installation.

Figure 5:
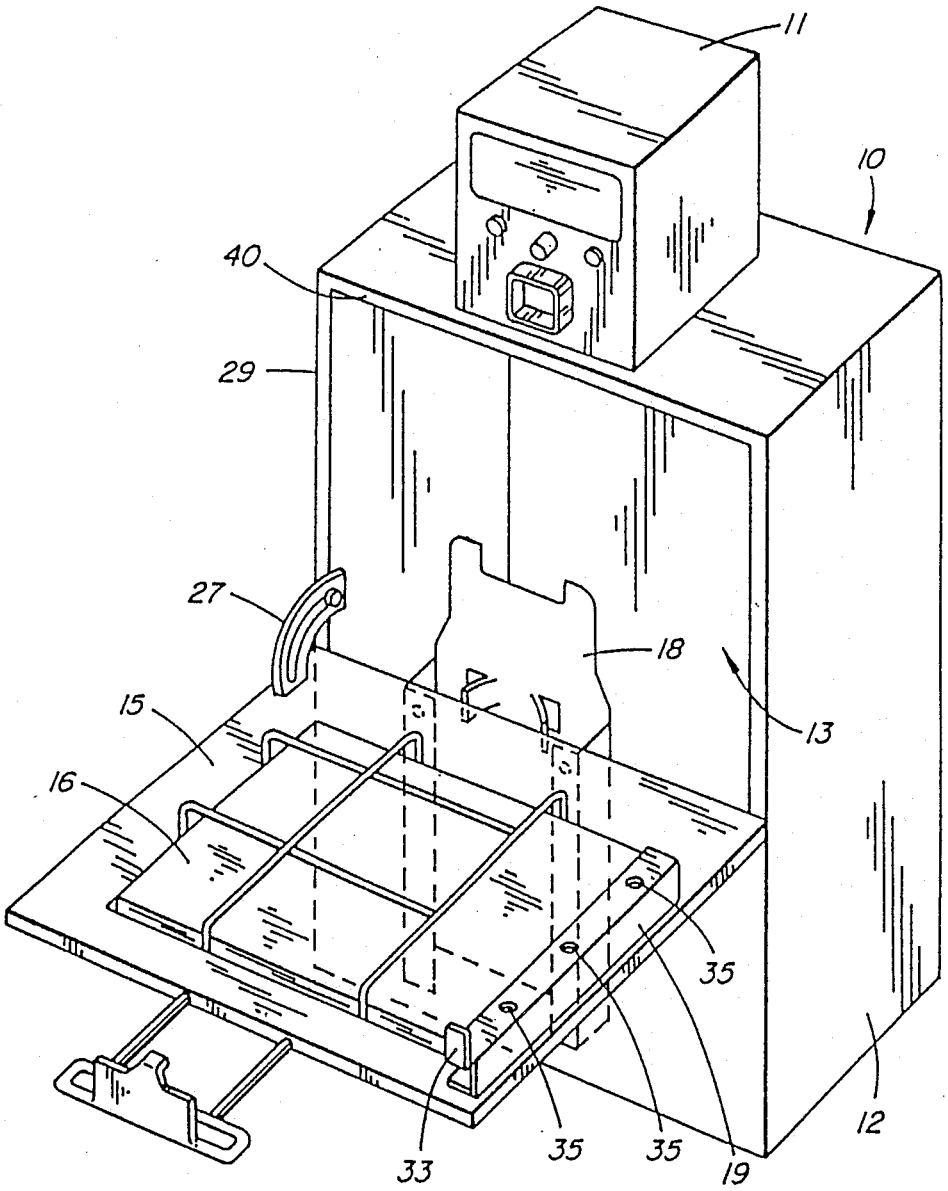
FIG. 5 is a perspective view of the coin-operated newspaper dispensing machine of FIG. 1 with the front cover panel of the present invention removed and showing the location of the cover panel mounting bracket.

At the bottom of cover panel 20 is a mounting assembly 36 for mounting the cover panel within the cabinet 12. Mounting assembly 36 includes a pair of spring-biased shoulder bolts 37 and a mounting plate 38. Mounting plate 38 is arranged to mount to a cover panel mounting bracket 18 specifically designed to receive plate 38 in a location inside the cabinet 12 directly behind the hinge of door 15. The proper location of the cover panel mounting bracket 18 within cabinet 12 is shown in FIG. 5. While the mounting of cover panel 20 and cover panel mounting bracket 18 inside cabinet 12 will be fully described later herein, it is to be noted that the top lip 24 on cover panel 20 is intended to overlie the front of lip 40 on cabinet 12 (FIG. 5) when the panel is in its mounted position.

Also mounted to cover panel 20 is a key lock mechanism 41. Lock mechanism 41 includes a stop 42 which pivots between an unlocked position in which it may be received through an opening 39 in mounting plate 38 and a locked position in which it limits movement of plate 38 towards cover panel 20 against the bias of springs 43.

Referring now also to FIG. 3, spaced behind lip 24 is a vertically extending flange 45 which extends nearly the full length of lip 23. The height of flange 45 is sized to permit it to fit under the lip 40 on cabinet 12 when mounting plate 38 is received on cover panel mounting bracket 18 and plate 38 is forced against the bottom of cover panel 20 against the urging of springs 43. Flange 45 thus prevents unauthorized removal of cover panel 20 by interference with lip 40.

Figure 4:
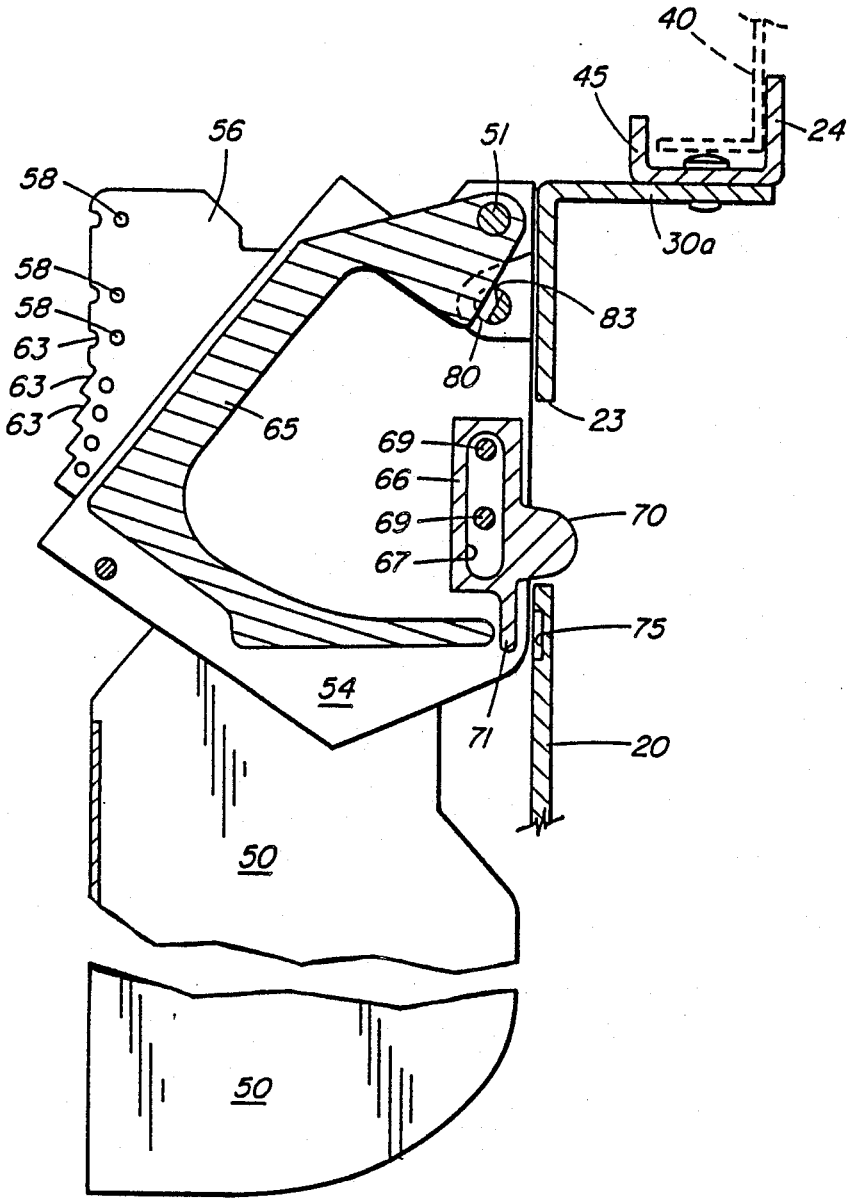
FIG. 4 is a fragmentary section view taken along lines 4—4 in FIG. 3.

Referring to FIGS. 3 and 4, a drag door 50 is pivotably mounted to rod 51 on opposite sides of vertical slot 22 on the rear side of cover panel 20 immediately above the T-shaped opening 21. The drag door 50 extends downward along the vertical slot 22 of the T-shaped opening a sufficient distance that its arcuate shaped lower surfaces will normally rest upon the top of a stack of newspapers loaded inside cabinet 12. The weight of drag door 50 thus provides a slight frictional resistance as newspapers are raised upwardly from the stack and withdrawn between drag door 50 and the rear surface of cover panel 20 and through the horizontal slot. The frictional resistance provided by drag door 50 is not sufficient to significantly inhibit withdrawal of newspapers from the cabinet, but is sufficient to inhibit would-be pilferers from easily rolling up relatively thin newspaper editions or other thin publications and withdrawing them through the vertical slot portion of the T-shaped opening. In addition to providing this function, drag door 50 also serves to guide the forward edge of newspapers being lifted from the stack into the proper position from which they are received through gauge gate 54.

Also pivotably mounted to the rod 51 on opposite sides of the vertical slot 22 is a gauge gate 54. Gauge gate 54 pivots independently of drag door 50 on rod 51. The forwardmost portion of gauge gate 54 extends downwardly from rod 51 only slightly below the bottom edge of horizontal slot 23, the purpose for this being to minimize the distance over which the user must encounter the frictional resistance of the gauge gate in removing a newspaper from the machine. FIG. 3 shows the gauge gate 54 in its fully down position resting against the rear of panel cover 20 and restricting removal of newspapers through horizontal slot 23.

Figure 6:
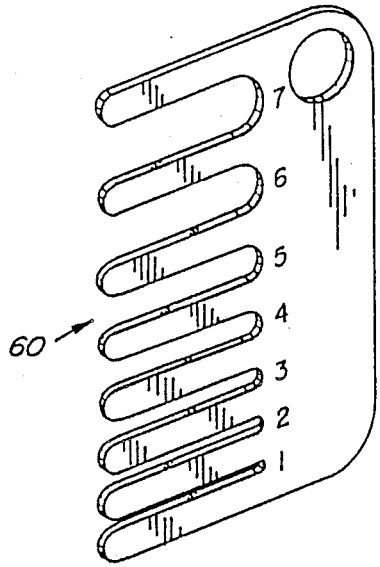
FIG. 6 is a perspective view of the template used to gauge newspapers of differing thicknesses.

Referring also to FIG. 4, fixedly mounted to the rear of panel cover 20 is a gauge gate bracket 56 which provides a means for selectively adjusting the relative opening of the gauge gate 54 to accommodate newspapers of varying thicknesses. Gauge gate bracket 56 is freely received through a slot 57 on the back panel of gauge gate 54. Gauge gate bracket 56 is provided with a series of seven spaced apart holes 58. Each of the holes 58 are sized to receive therethrough clevis pin 55 which is attached by a connecting chain 59 to the rear panel of gauge gate 54. Clevis pin 55 thus serves to limit the rearward pivoting of gauge gate 54. Varying the rearward pivoting of gauge gate 54 correspondingly varies the relative opening between the front surface of gauge gate 54 and the rear facing surface of cover panel 20. Each of the seven holes 58 is therefore positioned to permit gauge gate 54 to pivot an amount corresponding to a predetermined gauge thickness on template 60 (FIG. 6).

On the rear facing edge of gauge gate 54 are a series of seven detents 63, each one associated with a different one of the seven holes 58. The purpose of detents 63 is to permit the desired hole 58 to be quickly ascertained and selected by "feel". This feature is particularly desirable when loading of newspapers into the machine is accomplished at night.

Operably associated with the gauge gate 54 is a cam-actuated locking means which prevents successive withdrawal of newspapers through the horizontal slot. The locking means includes a pair of locking arms 65 pivotably mounted on rod 51 on opposed sides of vertical slot 22 and a pair of sensors 66 slidably mounted to gauge gate 54. Although only one locking arm 65 and sensor 66 is shown in FIG. 4, the other locking arm and sensor is identically shaped and functions in the same manner as that shown, thus a description of one will suffice for both.

Sensor 66 is capable of movement only along a guide slot 67 therein extending vertically in FIG. 4 and guided by a pair of rivets 69 aligned vertically with gauge gate 54 in its fully down position. Sensor 66 includes a forward extending arcuate shaped surface 70 which is positioned to reside within the horizontal slot 23 when gauge gate 54 is in its fully down position. Sensor 66 also includes a downwardly extending projection 71 which serves to limit downward pivoting of locking arm 65 and thereby prevents the lower tip of locking arm 65 from extending forwardly from gauge gate 54.

When locking arm 65 is in the unlocked position shown in FIG. 4, a newspaper can be raised upwardly along the rear of cover panel 20 and removed through horizontal slot 23. As a paper is removed through horizontal slot 23, gauge gate 54 will pivot upwardly and at the same time, sensor 66 will be raised by frictional contact with the newspaper. When this occurs, the lower tip of locking arm 65 will pivot forwardly from gauge gate 54, preventing sensor 66 from returning to its fully down position. Once the newspaper has been removed clear of horizontal slot 23, the lower tip of locking arm 65 will enter the recess 75 formed in the rear of cover panel 20. Torsion springs, not shown, bias each of the locking arms 65 against cover panel 20 to prevent unauthorized impact resetting of the locking arms. Locking arms 65 thus serve to prevent successive removal of newspapers through the horizontal slot until locking arm 65 is reset to its unlocked position in a manner which will now be described.

Referring now also to FIG. 3, the locking arm 65 is returned to its unlocked position by a cam-actuated reset mechanism. The reset mechanism includes a horizontally extending actuating rod 80 rotatably mounted on the rear of cover panel 20 above horizontal slot 23 and below rod 51. At the leftmost end of rod 80 in FIG. 3, integrally extending vertically therefrom, is a striker rod 81. In its vertical orientation shown in FIG. 3, striker rod 81 is coextensive with the lowermost horizontal slot 32 in cover panel 20. Torsion spring 84 biases rod 80 so that striker rod 81 is normally in its vertical orientation shown in FIG. 3. Rod 80 has a pair of cam surfaces 83 (FIG. 4) associated with each of the pair of locking arms 65. Although only one cam surface 83 is shown in FIG. 4 it is to be understood that the other cam surface is identical thereto and a description of one will suffice for both. When striker rod 81 is in its vertical orientation (door 15 open), the cam surface 83 will be rotated to the non-interfering position with locking arm 65 shown in FIG. 4. However, when access door 15 is closed, reset tab 33 will be caused to enter through the horizontal slot 32 and strike striker rod 81, pivoting striker rod 81 rearwardly and causing the cam surface to rotate counterclockwise as seen in FIG. 4, thereby forcing locking arm 65 to pivot rearwardly until the lower tip thereof clears the projection 71. Once projection 71 is cleared, sensor 66 will slide downwardly and projection 71 will prevent locking arm 65 from pivoting to its locked position until another newspaper is removed through the horizontal slot 23 of T-shaped opening 21.

A deactivation means is also provided to deactivate the cam-actuated locking means. As seen in FIG. 3, a clevis pin similar to pin 55 can be inserted in a through hole 90 in actuating rod 80 to retain the striker rod 81 in a down or out of the way orientation. This renders the cam actuating mechanism inoperable. This feature may be desirable when installing the anti-theft device of the present invention in a new location until users are acquainted with the operation of the machine.

Figure 7:
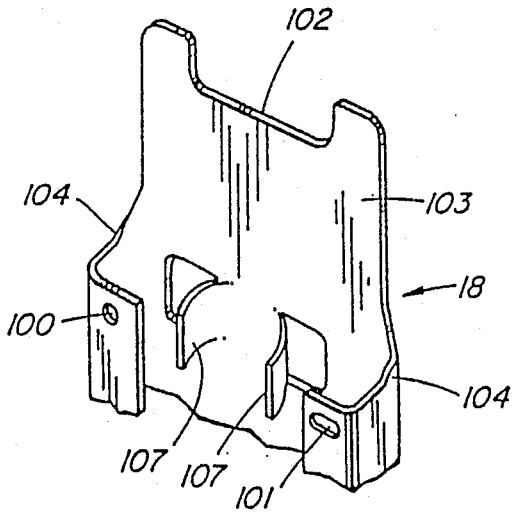
FIG. 7 is a fragmentary perspective view of the cover panel mounting bracket.

Referring now to FIGS. 5 and 7, the construction of the cover panel mounting bracket 18 will be described in greater detail. The bracket 18 has a generally C-channel shaped cross section along most of its vertical height as seen in FIG. 5. The width of the channel shaped portion of bracket 18 is sized smaller than the spacing between the spring-biased shoulder bolts 37 mounted to cover panel 20 so that the shoulder bolts will not bind against the bracket 18 when the cover panel sub-assembly is removed from cabinet 12 during loading and unloading. As can best be understood by reference to FIG. 5, mounting plate 38 is intended to be received upon the top edge of the channel shaped portion of bracket 18.

Figure 8:
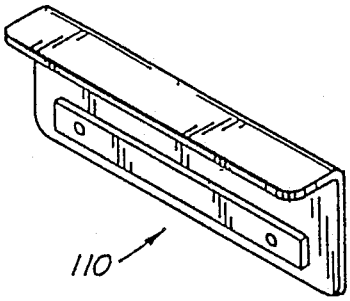
FIG. 8 is a perspective view showing the template used to mount the cover panel mounting bracket to the cabinet.

At the extreme upper portion of the channel shaped portion of bracket 18 are two spaced apart mounting holes 100 and 101 through which bracket 18 is bolt mounted to the inside facing front wall of cabinet 12, directly below the hinged access door 15. Unlike the reset tab mounting bracket 19, cover panel mounting bracket 18 does not mount to preexisting holes in the cabinet. Therefore, in order to facilitate the proper mounting of bracket 18 to cabinet 12, a template 110 (FIG. 8) is provided through which corresponding spaced holes in the cabinet 12 may be drilled.

Located at approximately the same height as mounting holes 100 and 101 and extending forwardly and outwardly from the rear wall of bracket 18 are a pair of cutouts 107. The top edge of the cutouts 107 are aligned with the top edge of the channel shaped portion of bracket 18 and provide a further reinforcing surface for supporting thereon the mounting plate 38.

At the upper portion of bracket 18 extending from the rear wall thereof is a stop wall 103. The purpose of stop wall 103 is to assist in retaining the cover panel sub-assembly in its mounted position within the cabinet 12 by preventing rearward movement the bottom portion of the cover panel 20 within the cabinet. Stop wall 103 is of sufficient height that the elevator mechanism within cabinet 12 cannot be raised above it and possibly bind against it when lowered. The top edge 102 of stop wall 103 has a recess which is shaped to conform with the shape of the bottom portion of the vertical slot 22 in cover panel 20. The width of stop wall 103 is narrower along its upper portion to provide clearance for shoulder bolts 37 when cover panel sub-assembly 17 is unlocked from cabinet 12 and pivoted down onto door 15 during loading and unloading of the machine. At the juncture of stop wall 103 and the top rear corners of the C-channel shaped portion of bracket 18 are a pair of forwardly extending wedge shaped sections 104 which assist to prevent the spring-biased mounting plate 38 from binding against bracket 18 as the cover panel sub-assembly is downwardly and forwardly pivoted during loading and unloading.

In order to retrofit the device of the present invention into a previously existing dispensing machine of the type shown in FIGS. 1 and 3, it is only necessary to (1) mount the cover panel mounting bracket 18 inside cabinet 12 using the template 110 to properly locate and drill the mounting holes, (2) mount the reset tab mounting bracket 19 to the rear facing side of access door 15 by bolting to three previously existing mounting holes in door 15, and (3) inserting the cover panel sub-assembly 17 into the front facing access opening in cabinet 12 with the locking mechanism unlocked to allow the flange 45 at the top of cover panel 20 to clear the lip 40 on cabinet 12 and (4) locking the cover panel lock mechanism with the lock key.

In order to access the cabinet 12 for loading and unloading a stack of newspapers therein, it is only necessary to (1) open the access door 15 and unlock the cover panel lock mechanism with the lock key, (2) press downwardly on the cover panel sub-assembly until the flange 45 at the top of cover panel 20 clears the lip 40 on cabinet 12, and (3) pivot the cover panel sub-assembly 17 downwardly and forwardly until it rests on the access door 15 with the reset tab 33 extending through the uppermost horizontal slot 31 in cover panel 20.

The sequence of operations which are accomplished in purchasing and removing a newspaper from the dispensing machine 10 is described as follows: (1) the proper amount of coins are inserted into the coin mechanism and the access door 15 is pulled down, (2) the purchaser grasps the top paper on the stack through the vertical slot in the manner depicted in the instructions displayed on the front of cover panel 20 (FIG. 2), the purchaser raises the newspaper through the drag door 50 and gauge gate 54 and out the horizontal slot 23, and (3) after removing the newspaper, the access door 15 is closed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An anti-theft apparatus for use in a dispensing machine for newspapers and the like having a coin-operated locking access door, comprising:

(a) a cover panel sized to mount within and restrict through the access opening of the dispensing machine, said cover panel having horizontal and vertical slots therein defining a T-shaped access opening, wherein said horizontal slot is spaced to extend above the topmost of newspapers and the like stacked within said dispensing machine, wherein the width of said vertical slot is sized substantially smaller than the width of newspapers and the like stacked within the dispensing machine while being sufficiently wide to permit grasping of newspapers and the like stacked within the dispensing machine, and wherein the width of said horizontal slot is sized to permit newspapers and the like stacked within the dispensing machine to be withdrawn therethrough along the axis of said horizontal slot; and (b) a restriction means for restricting the removal of newspapers and the like through said T-shaped access opening, said restriction means including (1) a gauge gate pivotably mounted to said cover above said T-shaped acess opening and pivoting bewteen an open position wherein newspapers and the like can be removed through said horizontal slot and a closed position wherein access through said horizontal slot is substantially restricted, (2) an adjustment means for selectively adjusting the relative opening of said gauge to accommodate newspapers and the like of varying thicknesses, and (3) a locking means operably associated with said gauge gate for preventing successive withdrawal of newspapers through said horizontal slot, said locking means including a reset means for resetting said locking means upon closing of the access door.

2. The apparatus of claim 1 wherein said restriction means further includes a drag door pivotally mounted to said cover panel above said T-shaped opening and extending substantially below said horizontal slot.

3. The apparatus of claim 1 wherein said locking means is cam-actuated and includes a cam shaft rotatably mounted on said cover panel, a reset tab mountable on the access door and operable to rotate said cam shaft as said access door is opened and closed, at least one locking arm pivotably mounted to said cover panel and operably associated with said cam shaft whereby rotation of said cam shaft caused by movement of said reset tab causes said locking arm to pivot between locked and unlocked positions, and at least one sensor moveably mounted to said gauge gate, said sensor positioned to move between locking arm hold and release positions, corresponding respectively to the unlocked and locked positions of said locking arm, as a newspaper or the like is raised to and removed through said horizontal slot and the access door is closed, said sensor returning to the hold position automatically upon closure of the access door.

4. The apparatus of claim 3 wherein said cam-acutated locking means includes a pair of locking arms pivotally mounted to said cover panel on opposed sides of said vertical slot and a pair of sensors corresponding to said pair of locking arms moveably mounted to said gauge gate.

5. The apparatus of claim 4 and further comprising:

deactivation means for deactivating said cam-actuated locking means, said deactivation means including a clevis pin insertable in said cam shaft and sized and arranged to interfere with the rotation of said cam shaft through interference contact with said cover panel.

6. The apparatus of claim 1 wherein said ajustment means includes a gauge gate bracket mounted to said cover panel, said gauge gate defining a slot receiving therethrough said gauge gate bracket, said gauge gate bracket having a plurality of spaced apart gauge holes corresponding to predetermined thicknesses of newspapers and the like to be stacked within the dispensing machine.

7. The apparatus of claim 6 wherein said gauge gate defines a detant associated with each of said plurality of gauge holes, said detants permitting the desired gauge hole setting to be non-visually selected.

8. An anti-theft dispensing apparatus as set forth in claim 6 in combination with a template for gauging the thickness of newspapers and the like to be stacked within the dispensing machine in order to determine the desired gauge setting on said gauge gate bracket.

9. The apparatus of claim 1 wherein said cover panel includes mounting means for removably mounting said cover panel within the access opening to the dispensing machine.

10. The apparatus of claim 9 wherein said mounting means includes spring means urging said cover panel against the dispensing machine.

11. The apparatus of claim 10 wherein said cover panel includes a panel locking means for locking said cover panel in its mounted position within the dispensing machine.

12. The apparatus of claim 11 wherein said panel locking means is located at the bottom of said cover panel.

13. An anti-theft apparatus for use in a dispensing machine for newspapers and the like having an coin-operated locking access door, comprising:

(a) a cover panel sized to mount within and restrict access through the access opening of the dispensing machine, said cover panel having horizontal and vertical slots wherein defining a T-shaped access opening, wherein said horizontal slot is spaced to extend above the topmost of newspapers and the like stacked within said dispensing machine, wherein the width of said vertical slot is sized substantially smaller than the width of newspapers and the like stacked within the dispensing machine while being sufficiently wide to permit grasping of newspapers and the like stacked within the dispensing machine, and wherein the width of said horizontal slot is sized to permit newspapers and the like stacked within the dispensing machine to be withdrawn therethrough along the axis of said horizontal slot; and (b) a restriction means for restricting the removal of newspapers and the like through said T-shaped access opening, said restriction means including (2) a gauge gate moveably mounted to said cover panel above said T-shaped access opening and moving between an open position wherein newspapers and the like can be removed through said horizontal slot and a closed position wherein access through said horizontal slot is substantially restricted, and (2) a cam-actuated locking means operably associated with said gauge gate for preventing successive withdrawal of newspapers through said horizontal slot, said cam-actuated locking means including a reset means for resetting said locking means upon closing of the access door.

14. The apparatus of claim 13 wherein said restriction means further includes a drag door pivotally mounted to said cover panel above said T-shaped opening and extending substantially below said horizontal slot.

15. The apparatus of claim 13 wherein said cam-actuated locking means includes a cam shaft rotatably mounted on said cover panel, a reset tab mountable on the access door and operable to rotate said cam shaft as said access door is opened and closed, at least one locking arm pivotably mounted to said cover panel and operably associated with said cam shaft whereby rotation of said cam shaft caused by movement of said reset tab causes said locking arm to pivot between locked and unlocked positions, and at least one sensor moveably mounted to said gauge gate, said sensor positioned to move between locking arm hold and release positions, corresponding respectively to the unlocked and locked positions of said locking arm, as a newspaper or the like is raised to and removed through said horizontal slot and the access door is closed, said sensor returning to the hold position automatically upon closure of the access door.

16. The apparatus of claim 15 wherein said cam-actuated locking means includes a pair of locking arms pivotably mounted to said cover panel on opposed sides of said vertical slot and a pair of sensors corresponding to said pair of locking arms moveably mounted to said gauge gate.

17. The apparatus of claim 16 and further comprising:

deactivation means for deactivating said cam-actuated locking means, said deactivation means including a clevis pin insertable in said cam shaft and sized and arranged to interfere with the rotation of said cam shaft through interference contact with said cover panel.

18. The apparatus of claim 13 wherein said cover panel includes mounting means for removably mounting said cover panel within the access opening to the disengaging machine.

19. The apparatus of claim 10 wherein said mounting means includes spring means urging said cover panel against the dispensing machine.

20. The apparatus of claim 19 wherein said cover panel includes a panel locking means for locking said cover panel in its mounted position within the dispensing machine.

21. The apparatus of claim 20 wherein said panel locking means is located at the bottom of said cover panel.

22. The apparatus of claim 13 wherein said restriction means further includes a gauge gate bracket mounted to said cover panel, said gauge gate defining a slot receiving therethrough said gauge gate bracket, said gauge gate bracket having a plurality of spaced apart gauge holes corresponding to predetermined thicknesses of newspapers and the like to be stacked within the dispensing machine.

23. The apparatus of claim 22 wherein said gauge gate defines a detant associated with each of said plurality of gauge holes, said detants permitting the desired gauge hole setting to be non-visually selected.

24. An anti-theft dispensing apparatus as set forth in claim 22 in combination with a template for gauging the thickness of newspapers and the like to be stacked within the dispensing machine in order to determine the desired gauge setting on said gauge gate bracket.

25. An anti-theft apparatus for use in a dispensing machine for newspapers and the like having a coin-operated locking access door, comprising:

(a) a cover panel sized to mount within and restrict acces through the access opening of the dispensing machine, said cover panel having horizontal and vertical slots therein defining a T-shaped access opening, wherein said horizontal slot is spaced to extend above the topmost of newspapers and the like stacked within said dispensing machine, wherein the width of said vertical slot is sized substantially smaller than the width of newspapers and the like stacked within the dispensing machine while being sufficiently wide to permit grasping of newspapers and the like stacked within the dispensing machine, and wherein the width of said horizontal slot is sized to permit newspapers and the like stacked within the dispensing machine to be withdrawn therethrough along the axis of said horizontal slot; and (b) a restriction means for restricting the removal of newspapers and the like through said T-shaped access opening, said restriction means including (1) a gauge moveably mounted to said cover panel above said T-shaped access opening and moving between an open position wherein newspapers and the like can be removed through said horizontal slot and a closed position wherein access through said horizontal slot is substantially restricted, (2) an adjustment means for selectively adjusting the relative opening of said gauge gate to accommodate newspapers and the like of varying thicknesses, and (3) a locking means operably associated with said gauge gate for preventing successive withdrawal of newspapers through said horizontal slot.

26. The apparatus of claim 25 wherein said restriction means further includes a drag door pivotably mounted to said cover panel above said T-shaped opening and extending substantially below said horizontal slot.

27. An anti-theft apparatus for use in a dispensing machine for newspapers and the like having a coin-operated locking accecss door, comprising:

(a) a cover panel sized to mount within the access opening of the dispensing machine, said cover panel having a restricted access opening suitably sized and arranged to permit grasping of newspapers and the like stacked within the dispensing machine while also substantially restricting group removal of newspapers and the like stacked within the dispensing machine; and (b) an adjustable restriction means for selectively adjusting the effective size of said restricted access opening so as to selectively limit the thickness of newspapers and the like which may be removed through said restricted accecss opening, said adjustable restriction means including (1) a gauge gate pivotably mounted to said cover panel above said restricted access opening and pivoting between an open position wherein a newspaper and the like of predetermined thickness can be removed therethough and a closed position wherein access therethrough is substantially restricted, (2) a drag door pivotally mounted to said cover panel above said restricted acces opening and extending substantially below said gauge gate, and (3) a limit means for selectively limiting the relative opening of said gauge gate to accommodate newspapers and the like of varying thicknesses; and (c) a cam-actuated locking means operably associated with said gauge gate for preventing successive withdrawal of newspapers through said restricted access opening, said cam-actuated locking means including a reset means for resetting said locking means upon closing of the access door.

28. An anti-theft apparatus for use in a dispensing machine for newspapers and the like having a coin-operated locking access door, comprising:

(a) a cover panel sized to mount within the access opening of the dispensing machine, said cover panel having a restricted access opening suitably sized and arranged to permit grasping of newspapers and the like stacked within the dispensing machine while also substantially restricting group removal of newspapers and the like stacked within the dispensing machine; and (b) an adjustable restriction means for selectively adjusting the effective size of said restricted access opening so as to selectively limit the thickness of newspapers and the like which may be removed through said restricted access opening, said adjustable restriction means including (1) a gauge gate pivotably mounted to said cover panel above said restricted access opening and pivoting between an open position wherein a newspaper and the like of predetermined thickness can be removed therethrough and a closed position wherein access therethrough is substantially restricted, and (2) a limit means for selectively limiting the relative opening of said gauge gate to accommodate newspapers and the like of varying thicknesses; and (c) a cam-actuated locking means operably associated with said gauge gate for preventing successive withdrawal of newspapers through said restricted access opening, said cam-actuated locking means including a reset means for resetting said locking means upon closing of the access door, a cam shaft rotatably mounted on said cover panel, a reset tab mountable on the access door and operable to rotate said cam shaft as said door is opened and closed, at least one locking arm pivotably mounted to said cover panel and operably associated with said cam shaft whereby rotation of said cam shaft caused by movement of said reset tab causes said locking arm to pivot between locked and unlocked positions, and at least one sensor moveably mounted to said gauge gate, said sensor positioned to move between locking arm hold and release positions, corresponding respectively to the unlocked and locked positions of said locking arm, as a newspaper or the like is raised to and removed through said horizontal slot and the access door is closed, said sensor returning to the hold position automatically upon closure of the access door.

29. The apparatus of claim 28 wherein said cam-actuated locking means includes a pair of locking arms pivotably mounted to said cover panel on opposed sides of said vertical slot and a pair of sensors corresponding to said pair of locking arms moveably mounted to said gauge gate.

30. An anti-theft apparatus for use in a dispensing machine for newspapers and the like having a coin-operated locking access door, comprising:

(a) a cover panel sized to mount within the access opening of the dispensing machine, said cover panel having a restricted access opening suitably sized and arranged to permit grasping of newspapers and the like stacked within the dispensing machine while also substantially restricting group removal of newspapers and the like stacked within the dispensing machine; and (b) a restriction means for restricting the removal of newspapers and the like through said restricted access opening, said restriction means including (1) a guage gate pivotally mounted to said cover panel above said restricted access opening and pivoting between an open position wherein newspapers and the like can be removed through restricted access opening and a closed position wherein access through said restricted access opening is substantially restricted, (2) a drag door pivotably mounted to said cover panel above said restricted access opening and extending substantially below said horizontal slot, (3) an adjustment means for selectively adjusting the relative opening of said gauge gate to accommodate newspapers and the like of varying thicknesses, and (4) a cam-actuated locking means operably associated with said gauge gate for preventing successive withdrawal of newspapers through said restricted access opening.

31. The apparatus of claim 30 wherein said cam-actuated locking means includes a cam shaft rotatably mounted on said cover panel, a reset tab mountable on the access door and operable to rotate said cam shaft as said access door is opened and closed, at least one locking arm pivotably mounted to said cover panel and operably associated with said cam shaft whereby rotation of said cam shaft caused by movement of said reset tab causes said locking arm to pivot between locked and unlocked positions, and at least one sensor moveably mounted to said gauge gate, said sensor positioned to move between locking arm hold and release positions, corresponding respectively to the unlocked and locked positions of said locking arm, as a newspaper or the like is raised to and removed through said horizontal slot and the access door is closed, said sensor returning to the hold position automatically upon closure of the accees door.

32. The apparatus of claim 31 wherein said cam-actuated locking means includes a pair of locking arms pivotably mounted to said cover panel on opposed sides of said vertical slot and a pair of sensors corresponding to said pair of locking arms moveably mounted to said gauge gate.

* * * * *

UNITED STATES PATENT AND TRADEMARK OFFICE

CERTIFICATE OF CORRECTION

PATENT NO. : 4,981,236

DATED : January 1, 1991

INVENTOR(S) : Riedle et al.

It is certified that error appears in the above-identified patent and that said Letters Patent is hereby corrected as shown below:

At column 8, line 30, following the word "restrict", insert --access--.

At column 8, line 50, following the word "cover", insert --panel--.

At column 8, line 51, "acess" should read --access--.

At column 8, line 52, "bewteen" should read --between--.

At column 8, line 58, following the word "gauge", insert --gate--.

At column 8, line 68, "pivotally" should read --pivotably--.

At column 10, line 2, "an" should read --a--.

At column 10, line 7, "wherein" should read --therein--.

At column 10, line 24, "(2)" should read --(1)--.

At column 11, line 43, "acces" should read --access--.

UNITED STATES PATENT AND TRADEMARK OFFICE

CERTIFICATE OF CORRECTION

PATENT NO. : 4,981,236

DATED : January 1, 1991

INVENTOR(S) : Riedle et al.

It is certified that error appears in the above-identified patent and that said Letters Patent is hereby corrected as shown below:

At column 12, line 27, "accecss" should read --access--.

At column 12, line 37, "acces" should read --access--.

At column 14, line 4, "guage" should read --gauge--.

Signed and Sealed this

Twenty-sixth Day of May, 1992

*Attest:*

DOUGLAS B. COMER

*Attesting Officer*

*Acting Commissioner of Patents and Trademarks*